US011586135B2

(12) United States Patent
Gon

(10) Patent No.: US 11,586,135 B2
(45) Date of Patent: Feb. 21, 2023

(54) IMAGE FORMING APPARATUS

(71) Applicant: KYOCERA Document Solutions Inc., Osaka (JP)

(72) Inventor: Shoko Gon, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/675,680

(22) Filed: Feb. 18, 2022

(65) Prior Publication Data

US 2022/0269202 A1 Aug. 25, 2022

(51) Int. Cl.
*G03G 15/20* (2006.01)

(52) U.S. Cl.
CPC ..... *G03G 15/2064* (2013.01)

(58) Field of Classification Search
None
See application file for complete search history.

(56) References Cited

U.S. PATENT DOCUMENTS 8,559,837 B2 * 10/2013 Nakayama ..... G03G 15/6594 399/68
8,867,942 B2 * 10/2014 Ikeda ..... G03G 15/206 399/328
2007/0019978 A1 * 1/2007 Kim ..... G03G 15/2064 399/328
2007/0059061 A1 * 3/2007 Katayama ..... G03G 15/206 399/329
2009/0060541 A1 * 3/2009 Takeuchi ..... G03G 15/2064 399/45
2010/0111579 A1 * 5/2010 Condello ..... G03G 15/2028 399/329
2011/0222874 A1 * 9/2011 Yamada ..... G03G 15/206 399/329
2011/0222879 A1 * 9/2011 Okamoto ..... G03G 15/2032 399/329
2011/0222881 A1 * 9/2011 Yamada ..... G03G 15/2032 399/329

(Continued)

FOREIGN PATENT DOCUMENTS

JP 2010-78903 A 4/2010
JP 2010-181728 A 8/2010
JP 2019-159247 A 9/2019

*Primary Examiner* — Sevan A Aydin
(74) *Attorney, Agent, or Firm* — Stein IP, LLC

(57) ABSTRACT

An image forming apparatus includes an image forming portion, a fixing device, an input portion, and a control portion. The fixing device includes a rotary member to be heated, a pressure-applying rotary member, a heat-applying portion, a pressure-applying mechanism, and a reference position detection mechanism. The control portion controls fixing processing, with the pressure-applying rotary member disposed at any of a plurality of pressure-applying positions and a pressure reduction position based on a type of the recording medium inputted through the input portion. The control portion performs control so that when a prescribed amount of time has elapsed or when a rotation amount of a shaft has reached a prescribed amount from timing at which a reference position detection sensor is brought to an on-state, the pressure-applying drive motor is stopped so as to dispose the pressure-applying rotary member at any of the plurality of pressure-applying positions.

15 Claims, 7 Drawing Sheets

(56) References Cited

U.S. PATENT DOCUMENTS

| | | | | |
|---|---|---|---|---|
| 2016/0378031 | A1* | 12/2016 | Takahashi | G03G 15/2053 399/329 |
| 2017/0082961 | A1* | 3/2017 | Saito | G03G 15/2032 |
| 2018/0112762 | A1* | 4/2018 | Nieda | G03G 15/2032 |
| 2020/0096916 | A1* | 3/2020 | Tanaka | G03G 15/607 |

* cited by examiner

IMAGE FORMING APPARATUS

INCORPORATION BY REFERENCE

This application is based upon and claims the benefit of priority from the corresponding Japanese Patent Application No. 2021-28364 (filed on Feb. 25, 2021), the entire contents of which are incorporated herein by reference.

BACKGROUND

The present disclosure relates to an image forming apparatus including a fixing device, such as a copy machine, a printer, a facsimile, or a multi-functional peripheral equipped therewith, and particularly to a method for achieving both of fixability and sheet conveyance capability.

In image forming apparatuses, a fixing device including a fixing member composed of a fixing roller or a fixing belt (a rotary member to be heated) and a pressure-applying roller (a pressure-applying rotary member) that are in pressure contact with each other is widely used to fix a toner image to a sheet. In the fixing device, a recording material such as a sheet is passed through a fixing nip formed by a heat-applying roller and the pressure-applying roller so that heat and pressure are applied to a toner image to fuse and fix the toner image to the recording material.

In the fixing device as described above, a temperature of the fixing roller or the fixing belt and a nip pressure at the fixing nip are set in consideration of toner fixability to a recording material. However, in a case of fixing a toner image to a special sheet different in type from a plain sheet under heat-applying and pressure-applying conditions set in consideration of toner fixability to, for example, the plain sheet, wrinkles are likely to form in the recording material.

To address this issue, there has been proposed a fixing device that suppresses formation of wrinkles without impairing fixability of a toner image to a special sheet such as an envelope. For example, there is known a fixing device including a recognition unit that recognizes a thickness of a member to be subjected to fixing and a pressure contact force switching unit that switches a pressure contact force of a pressure contact member to a smaller value than in a case of fixing with respect to a plain sheet when the thickness of the member to be subjected to fixing recognized by the recognition unit is larger than that of the plain sheet.

Furthermore, there is also known an image forming apparatus including a heat-applying portion that heats a recording sheet on which a toner image has been transferred, a pressure-applying portion that presses the heat-applying portion so as to form a prescribed nip, a conveyance drive unit that drives at least one of the heat-applying portion and the pressure-applying portion so as to convey the recording sheet in a prescribed direction via the nip at a prescribed conveyance speed, and a pressure application amount control unit that controls an amount of pressure applied by the pressure-applying portion. In the image forming apparatus, the pressure application amount control unit controls the amount of pressure applied by the pressure-applying portion correspondingly to a type of the recording sheet.

There is known a fixing device that has a pressure release mode in which a fixing nip is set to provide a first pressure and a pressure-applying mode in which the fixing nip is set to provide a second pressure larger than the first pressure. In the pressure release mode, the fixing device enters into a fixing operation standby state, and the fixing device performs sheet feeding and fixing of a recording medium of a particular type in the pressure release mode, while performing sheet feeding and fixing of a recording medium of a type other than the particular type in the pressure-applying mode.

SUMMARY

An image forming apparatus according to an aspect of the present disclosure includes an image forming portion, a fixing device, an input portion, and a control portion. The image forming portion forms a toner image on a recording medium. The fixing device includes a rotary member to be heated, a pressure-applying rotary member that is brought into pressure contact at a prescribed fixing nip pressure with the rotary member to be heated so as to form a fixing nip, a heat-applying portion that heats the rotary member to be heated, a pressure-applying mechanism, and a reference position detection mechanism. The fixing device performs fixing processing in which the recording median passing through the fixing nip is subjected to heating and pressing so that the toner image is fixed to the recording medium. The pressure-applying mechanism includes a pressure-applying lever that is used to move the pressure-applying rotary member in a direction toward or away from the rotary member to be heated, a pressing cam that causes a pressing force applied by the pressure-applying lever to vary, and a pressure-applying drive motor that rotates a shaft to which the pressing cam is secured. The reference position detection mechanism includes a light blocking plate that is secured to the shaft and a reference position detection sensor that is brought to an on-state or an off-state by the light blocking plate. The reference position detection mechanism detects that the pressure-applying rotary member is at a reference position. The input portion is capable of receiving an input of information on a type of the recording medium. The control portion controls the pressure-applying mechanism based on the information on a type of the recording medium inputted through the input portion so as to adjust a position where the pressing is performed. The pressure-applying mechanism selectively disposes the pressure-applying rotary member at a plurality of pressure-applying positions for applying a fixing nip pressure having different values from each other, which includes a first pressure-applying position and a second pressure-applying position for applying the fixing nip pressure having a value smaller than at the first pressure-applying position, and a pressure reduction position for applying the fixing nip pressure having a value smaller than at the pressure-applying positions. The control portion performs control so that, in a case where the recording medium is a normal sheet, the fixing processing is performed, with the pressure-applying rotary member disposed at any of the plurality of pressure-applying positions, and in a case where the recording medium is a special sheet, the fixing processing is performed, with the pressure-applying rotary member disposed at any of the plurality of pressure-applying positions and the pressure reduction position. The light blocking plate is so disposed that the reference position detection sensor is brought to the on-state at timing at which a rotation position of the pressing cam reaches a vicinity of any of the pressure-applying positions. The control portion performs control so that when, after forward rotation of the pressure-applying drive motor, a prescribed amount of time has elapsed or when a rotation amount of the shaft has reached a prescribed amount from timing at which the reference position detection sensor is brought to the on-state, the pressure-applying drive motor is stopped so as to dispose the pressure-applying rotary member at any of the plurality of pressure-applying positions.

DETAILED DESCRIPTION

Figure 1:
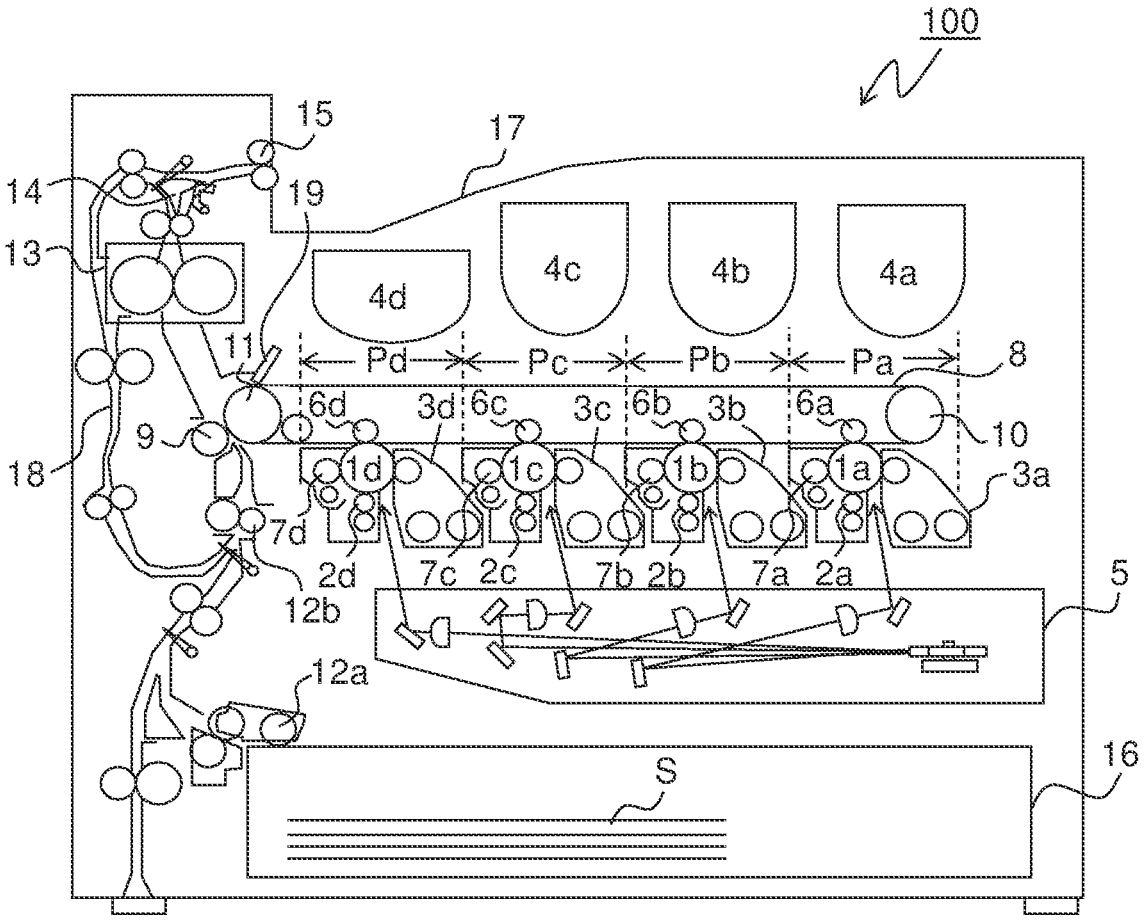
FIG. 1 is a schematic sectional view showing an internal structure of an image forming apparatus according to an embodiment of the present disclosure.

With reference to the appended drawings, the following describes an embodiment of the present disclosure. FIG. 1 is a schematic sectional view showing an internal structure of an image forming apparatus 100 according to the embodiment of the present disclosure. In a main body of the image forming apparatus 100 (herein, a color printer), four image forming portions Pa, Pb, Pc, and Pd are arranged in order from an upstream side (a right side in FIG. 1) in a conveyance direction. The image forming portions Pa to Pd are provided so as to correspond to images of four different colors cyan, magenta, yellow, and black) and each perform steps of charging, exposure, development, and transfer so as to sequentially form images of cyan, magenta, yellow, and black, respectively.

In the image forming portions Pa to Pd, photosensitive drums (image carriers) 1*a*, 1*b*, 1*c*, and 1*d* are arranged, respectively, to carry visible images (toner images) of the respective colors. Moreover, an intermediate transfer belt 8 that rotates in a clockwise direction in FIG. 1 is provided adjacently to the image forming portions Pa to Pd. Toner images formed respectively on the photosensitive drums 1*a* to 1*d* are sequentially and primarily transferred on the intermediate transfer belt 8 and superimposed on each other, while the intermediate transfer belt 8 is moving in contact with the photosensitive drums 1*a* to 1*d*. After that, the toner images primarily transferred on the intermediate transfer belt 8 are secondarily transferred on a sheet S as an example of a recording medium by a secondary transfer roller 9. Moreover, the sheet S on which the toner images have been secondarily transferred is discharged from the main body of the image forming apparatus 100 after the toner images have been fixed thereto in a fixing device 13. An image forming process with respect to the photosensitive drums 1*a* to 1*d* is executed while the photosensitive drums 1*a* to *d* are being rotated in a counterclockwise direction in FIG. 1 by a main motor 50 (see FIG. 5).

The sheet S on which toner images are to be secondarily transferred is contained in a sheet cassette 16 disposed in a lower part in the main body of the image forming apparatus 100 and is conveyed to a nip between the secondary transfer roller 9 and a driving roller 11 of the intermediate transfer belt 8 via a paper feed roller 12*a* and a registration roller pair 12*b*. As the intermediate transfer belt 8, a seam-free (seamless) belt formed of a dielectric resin sheet is mainly used. Furthermore, a blade-shaped belt cleaner 19 for removing residual toner or the like remaining on a surface of the intermediate transfer belt 8 is disposed on a downstream side of the secondary transfer roller 9.

Next, a description is given of the image forming portions Pa to Pd. Around and below the rotatably arranged photosensitive drums 1*a* to 1*d*, there are provided charging devices 2*a*, 2*b*, 2*c*, and 2*d* that charge the photosensitive drums 1*a* to 1*d*, respectively, an exposure device 5 that performs exposure based on image information with respect to the photosensitive drums 1*a* to 1*d*, developing devices 3*a*, 3*b*, 3*c*, and 3*d* that form toner images on the photosensitive drums 1*a* to 1*d*, respectively, and cleaning devices 7*a*, 7*h*, 7*c*, and 7*d* that remove a residual developer (toner) or the like remaining on the photosensitive drums 1*a* to 1*d*, respectively.

Upon an input of image data from a host apparatus such as a personal computer, first, the charging devices 2*a* to 2*d* uniformly charge surfaces of the photosensitive drums 1*a* to 1*d*, respectively. Men, the exposure device 5 applies light correspondingly to image data so that electrostatic latent images corresponding to the image data are formed on the photosensitive drums 1*a* to 1*d*, respectively. The developing devices 3*a* to 3*d* are filled with prescribed amounts of two-component developer containing toner of the respective colors of cyan, magenta, yellow, and black, respectively. In a case where a proportion of the toner in the two-component developer filled in the developing devices 3*a* to 3*d* falls below a predetermined value as a result of after-mentioned toner image formation, the developing devices 3*a* to 3*d* are replenished with toner from toner containers 4*a* to 4*d*, respectively. By the developing devices 3*a* to 3*d*, the toner contained in the developer is supplied onto the photosensitive drums 1*a* to 1*d*, respectively, and electrostatically adheres thereto. Thus, there are formed toner images corresponding to the electrostatic latent images formed by exposure from the exposure device 5.

Further, by primary transfer rollers 6*a* to 6*d*, an electric field is applied at a prescribed transfer voltage between themselves and the photosensitive drums 1*a* to 1*d*, respectively, so that the toner images of cyan, magenta, yellow, and black formed respectively on the photosensitive drums 1*a* to 1*d* are primarily transferred on the intermediate transfer belt 8. These images of the four different colors are formed in a preset prescribed positional relationship for formation of a prescribed full color image. After that, in preparation for subsequent formation of new electrostatic latent images, residual toner or the like remaining on the surfaces of the photosensitive drums 1*a* to 1*d* after the primary transfer is removed by the cleaning devices 7*a* to 7*d*, respectively.

The intermediate transfer belt 8 is stretched around a driven roller 10 on an upstream side and the driving roller 11 on a downstream side. When the intermediate transfer belt 8 starts to rotate in the clockwise direction as the driving roller 11 is rotated by a belt drive motor (not shown), at prescribed timing, the sheet S is conveyed from the registration roller pair 12*b* to a nip (a secondary transfer nip) between the driving roller 11 and the secondary transfer roller 9 provided adjacently thereto. Further, a full-color image on the intermediate transfer belt 8 is secondarily transferred on the sheet S. The sheet S on which the toner images have been secondarily transferred is conveyed to the fixing device 13.

The sheet S conveyed to the fixing device 13 is subjected to heating and pressing by a fixing belt 21 and a pressure-applying roller 22 (see FIG. 2) so that the toner images are fixed to a surface of the sheet S, and thus a prescribed full-color image is formed thereon. A conveyance direction of the sheet S on which the full-color image has been formed is controlled by a branch portion 14 branching off in a plurality of directions, and the sheet S is directly (or after being sent to a double-sided conveyance path 18 for image formation on both sides thereof) discharged to a discharge tray 17 by a discharge roller pair 15.

Figure 2:
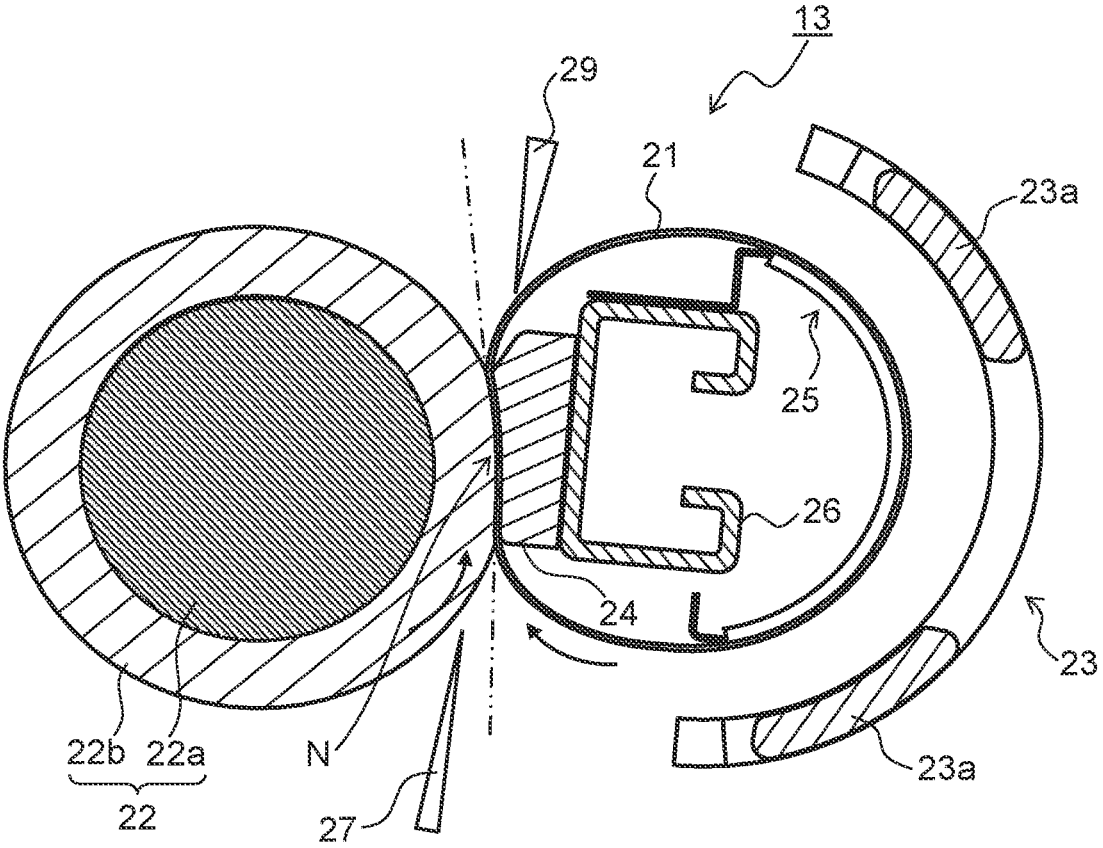
FIG. 2 is a side sectional view of a fixing device mounted in the image forming apparatus.

FIG. 2 is a side sectional view of the fixing device 13 mounted in the image forming apparatus 100. In FIG. 2, an upper side corresponds to a downstream side in a sheet insertion direction (conveyance direction) with respect to the fixing device 13, and a lower side corresponds to an upstream side in the sheet insertion direction with respect to the fixing device 13. As shown in FIG. 2, the fixing device 13 includes the fixing belt 21 (a rotary member to be heated), the pressure-applying roller 22 (a pressure-applying rotary member), a heat-applying portion 23, a nip forming member 24, a belt guide 25, and a frame member 26.

The fixing belt 21 is supported to a housing (not shown) of the fixing device 13 so as to be rotatable about a horizontal axis. The fixing belt 21 is formed in an endless cylindrical shape having, for example, an outer diameter of 20 mm to 50 mm and has a length in an axis direction thereof (a length in a width direction of the sheet S) substantially equal to that of the pressure-applying roller 22. The fixing belt 21 rotates in a clockwise direction in FIG. 2 along an insertion direction of the sheet S as a recording medium.

The fixing belt 21 has a laminar structure in which an elastic layer and a mold-release layer are stacked on an outer circumferential side of a heat-generating layer as a base layer. The heat-generating layer is formed of a film made of a metal such as nickel and having a thickness of, for example, 30 μm to 50 μm or a polyimide film blended with powder of a metal such as, for example, copper, silver, or aluminum and having a thickness of 50 μm to 100 μm. The elastic layer is made of silicone rubber or the like and has a thickness of, for example, 100 μm to 500 μm. The mold-release layer is made of a fluororesin such as PFA (tetrafluoroethylene-perfluoroalkyl vinyl ether copolymer) and has a thickness of, for example, 30 μm to 50 μm.

The pressure-applying roller 22 is supported to the housing of the fixing device 13 so as to be rotatable about the horizontal axis. The pressure-applying roller 22 is in a cylindrical column shape and has a length in an axis direction thereof (a length in the width direction of the sheet S) substantially equal to that of the fixing belt 21. By a pressure-applying mechanism 30 (see FIG. 3), a prescribed pressure is applied to the pressure-applying roller 22 toward the fixing belt 21. An outer circumferential surface of the pressure-applying roller 22 presses the nip forming member 24 via the fixing belt 21 so as to be brought into pressure contact with an outer circumferential surface of the fixing belt 21, thus forming a fixing nip N.

The pressure-applying roller 22 is joined to a fixing drive motor 45 (see FIG. 5) and thus is driven to rotate in a counterclockwise direction in FIG. 2. The pressure-applying roller 22 is in contact with the outer circumferential surface of the fixing belt 21 and thus applies a rotation drive force in the clockwise direction to the fixing belt 21.

The pressure-applying roller 22 has a laminar structure in which an elastic layer 22*h* is stacked on an outer circumferential side of a core bar 22*a* and a mold-release layer (not shown) is stacked on a surface of the elastic layer 22*h*. The core bar 22*a* is made of a metal such as aluminum and has a diameter of, for example, about 20 mm. The elastic layer 22*h* is made of silicone rubber or the like and has a thickness of, for example, about 8 mm. The mold-release layer is made of a fluororesin such as PFA and has a thickness of, for example, about 10 μm to 50 μm.

The heat-applying portion 23 is disposed in a region on an opposite side to a side on which the pressure-applying roller 22 is disposed with respect to the fixing belt 21 so as to be opposed at a prescribed distance to the outer circumferential surface of the fixing belt 21. The heat-applying portion 23 extends slightly longer than the fixing belt 21 along the axis direction of the fixing belt 21 (the width direction of the sheet S, a direction perpendicular to a plane of FIG. 2). The heat-applying portion 23 causes the heat-generating layer of the fixing belt 21 to generate heat by induction heating, thus heating the fixing belt 21.

The heat-applying portion 23 includes an excitation coil 23*a*, an unshown holding member, a core, and so on. The excitation coil 23*a* and the core are held at respective prescribed positions by the holding member. The excitation coil 23*a* is made of Litz wire formed of a bundle of a plurality of conductors and is wound to extend along the axis direction of the fixing belt 21. In a circumferential direction of the fixing belt 21, the excitation coil 23*a* is formed in an arc shape along the outer circumferential surface of the fixing belt 21.

The nip forming member 24 is disposed on an inner side of the fixing belt 21 so as to be opposed to the pressure-applying roller 22 via the fixing belt 21. The nip forming member 24 is in contact with an inner circumferential surface of the fixing belt 21 so as to form the fixing nip N between the fixing belt 21 and the pressure-applying roller 22.

The nip forming member 24 has substantially a rectangular parallelepiped shape extending for a length substantially equal to that of the fixing belt 21 along the axis direction of the fixing belt 21. The nip forming member 24 has a base member made of, for example, a metal such as aluminum or a heat-resistant resin such as a liquid crystal polymer.

The belt guide 25 is disposed on the inner side of the fixing belt 21 so as to be opposed to the heat-applying portion 23 via the fixing belt 21. The belt guide 25 is in contact with a part of the inner circumferential surface of the fixing belt 21 other than the fixing nip N and supports the fixing belt 21 from the inner side. The belt guide 25 is formed of a piece of sheet metal extending for a length substantially equal to that of the fixing belt 21 along the axis direction of the fixing belt 21. The belt guide 25 is made of an elastic magnetic metal such as SUS430 and has a thickness of, for example, 0.1 mm to 0.5 mm.

The frame member 26 is supported to a housing portion of the fixing device 13 and holds the nip forming member 24 and the belt guide 25. The frame member 26 is disposed at substantially a center of the fixing belt 21 in a radial direction thereof and between the belt guide 25 and the nip forming member 24. The frame member 26 extends slightly longer than the fixing belt 21 along the axis direction of the fixing belt 21.

A fixing entry guide 27 is disposed on an upstream side (the lower side in FIG. 2) of the fixing nip N with respect to the sheet insertion direction. The fixing entry guide 27 guides the sheet S that has passed through the secondary transfer nip (see FIG. 1) to the fixing nip N.

A separation claw 29 is disposed on a downstream side (the upper side in FIG. 2) of the fixing nip N with respect to the sheet insertion direction. The separation claw 29 separates the sheet S that has been subjected to fixing processing from a surface of the fixing belt 21. The separation claw 29 is disposed at a prescribed angle in such a manner that a distal end thereof is directed toward an upstream side (to a counter direction) with respect to a rotation direction of the fixing belt 21 and placed in proximity to the outer circumferential surface of the fixing belt 21.

Figure 3:
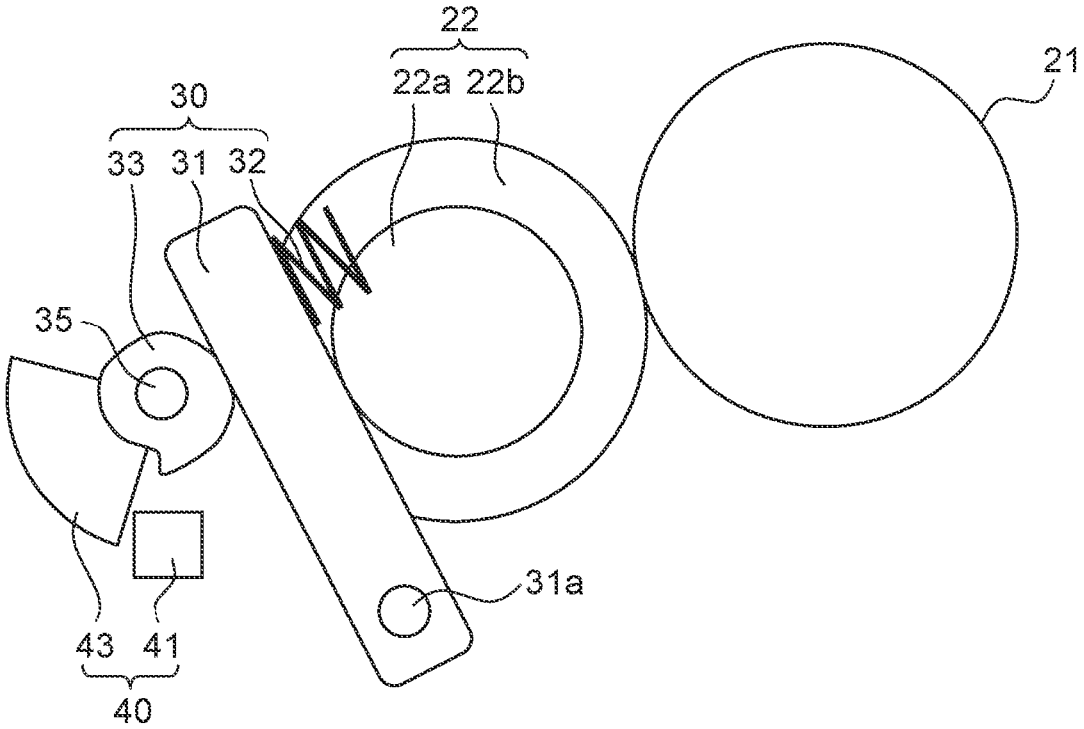
FIG. 3 is a side view of a pressure-applying mechanism and a reference position detection mechanism in the fixing device.
Figure 4:
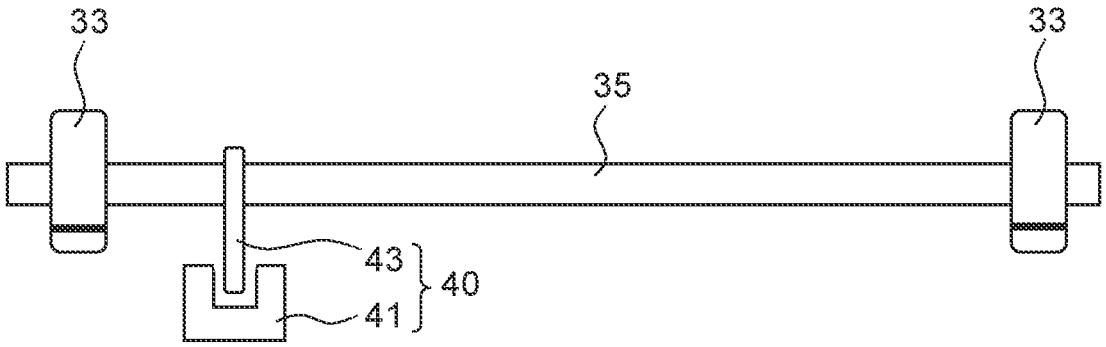
FIG. 4 is a front view of the reference position detection mechanism as viewed from a left side in FIG. 3.

FIG. 3 is a side view of the pressure-applying mechanism 30 and a reference position detection mechanism 40 in the fixing device 13. FIG. 4 is a front view of the reference position detection mechanism 40 as viewed from a left side in FIG. 3. FIG. 3 omits depictions of the nip forming member 24, the belt guide 25, and the frame member 26, which are disposed on the inner side of the fixing belt 21.

The pressure-applying mechanism 30 includes a pressure-applying lever 31, a coil spring 32, and a pressing cam 33. The pressure-applying lever 31 is pivotably supported to a support 31*a* and is in contact with the core bar 22*a* of the pressure-applying roller 22. The coil spring 32 biases the pressure-applying lever 31 in a direction away from the pressure-applying roller 22 (a counterclockwise direction in FIG. 3). The pressing cam 33 is secured to a shaft 35 and is an eccentric cam having a varying outer diameter based on a distance from the shaft 35 to an outer circumferential surface thereof. The pressure-applying lever 31 and the pressing cam 33 are disposed as a pair at each of both ends of the pressing roller 22 in an axial direction thereof.

The shaft 35 is joined to a pressure-applying drive motor 47 (see FIG. 5) and thus is driven to rotate, causing the outer diameter of the pressing cam 33 in a contact area between itself and the pressure-applying lever 31 to vary. When the outer diameter of the pressing cam 33 in the contact area increases, the pressure-applying lever 31 presses the core bar 22*a* in a direction toward the fixing belt 21 against a biasing force of the coil spring 3 and thus an increased fixing nip pressure is obtained. When the outer diameter of the pressing cam 33 decreases, the pressure-applying lever 31 moves in a direction away from the core bar 22*a* under the biasing force of the coil spring 32, and thus a decreased fixing nip pressure is obtained.

The reference position detection mechanism 40 includes a reference position detection sensor 41 and a light blocking plate 43. The reference position detection sensor 41 is formed of a PI (photointerrupter) sensor having a detection portion including a light emitting part and a light receiving part. The light blocking plate 43 is secured to the shaft 35, and when the shaft 35 rotates, the light blocking plate 43 passes through an optical path of the detection portion of the reference position detection sensor 41.

Next, a description is given of a method for detecting a pressure-applying position performed by the reference position detection mechanism 40. For example, the light blocking plate 43 is so disposed in advance that the reference position detection sensor 41 is brought to an on-state (a light blocking state) at timing at which a rotation position of the pressing cam 33 reaches substantially a vicinity of the pressure-applying position. Further, in this configuration, when the shaft 35 is forwardly rotated (rotated in the counterclockwise direction in FIG. 3) and thus a prescribed amount of time has elapsed (when a rotation amount of the pressing cam 33 has reached a prescribed amount) from a time when the reference position detection sensor 41 is brought to the on-state, a desired pressure-applying position is achieved.

Furthermore, during warming-up executed, for example, at power-on or recovery from a power saving mode (a sleep mode) of the image forming apparatus 100 and during a standby mode after the warming-up thereof, the fixing belt 21 is driven to rotate, with the pressure-applying roller 22 disposed at a pressure reduction position for applying a smaller nip pressure than at the pressure-applying position. This is intended, for example, to reduce physical stress exerted on the fixing belt 21 so that a service life thereof is prolonged, to suppress a phenomenon in which the fixing belt 21 is bent when stopped from rotating, to reduce a drive torque of the pressure-applying drive motor 47, and to achieve noise reduction.

Specifically, in this configuration, when the shaft 35 is reversely rotated (rotated in a clockwise direction in FIG. 3) and thus a prescribed amount of time has elapsed (when a rotation amount of the pressing cam 33 has reached a prescribed amount) from a time when the reference position detection sensor 41 is switched from the on-state to an off-state (a light transmitting state), a desired pressure reduction position is achieved.

Even when a drive time is constant, a rotation amount of the pressing cam 33 rotated by the pressure-applying drive motor 47 may somewhat vary due to variations in motor torque or load torque. When a variation amount falls within a permissible range, however, the rotation amount can be detected with prescribed accuracy by performing control through an operation of a timer. In a case of controlling the rotation amount of the pressing cam 33 with higher accuracy, an encoder (a pulse plate) is attached to the shaft 35 so as to detect the number of pulses passing through the reference position detection sensor 41. This can further enhance accuracy in detecting the rotation amount.

Figure 5:
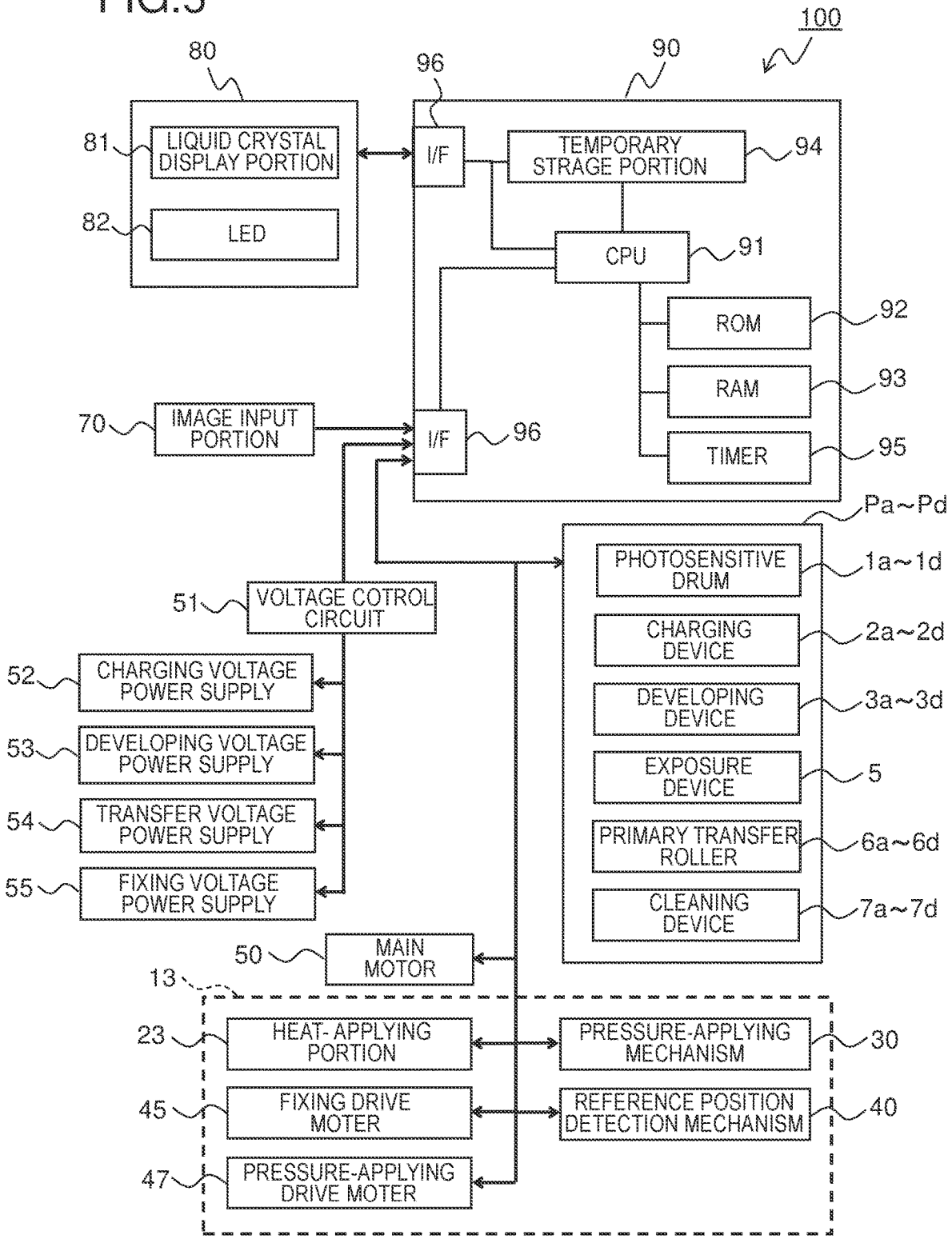
FIG. 5 is a block diagram showing an example of control paths of the image forming apparatus.

FIG. 5 is a block diagram showing an example of control paths of the image forming apparatus 100, In using the image forming apparatus 100, various portions thereof are variously controlled, and a description herein, therefore, focuses on parts of the control paths necessary to implement the present disclosure. Furthermore, the description omits what has already been described.

A voltage control circuit 51 is connected to a charging voltage power supply 52, a developing voltage power supply 53, a transfer voltage power supply 54, and a fixing voltage power supply 55 and activates each of these power supplies based on an output signal from a control portion 90. Each of these power supplies receives a control signal from the voltage control circuit 51, based on which the charging voltage power supply 52 applies a prescribed voltage to each of the charging devices 2*a* to 2*d*, the developing voltage power supply 53 applies a prescribed voltage to each of the developing devices 3*a* to 3*d*, the transfer voltage power supply 54 applies a prescribed voltage to each of the primary transfer rollers 6*a* to 6*d* and the secondary transfer roller 9, and the fixing voltage power supply 55 applies a prescribed voltage to the heat-applying portion 23 in the fixing device 13.

An image input portion 70 is a reception portion that receives image data transmitted from a personal computer or the like to the image forming apparatus 100. An image signal inputted through the image input portion 70 is converted into a digital signal, which then is fed out to a temporary storage portion 94.

In an operation portion 80, a liquid crystal display portion 81 and an LED 82 that indicates various types of states are provided to indicate a state of the image forming apparatus 100 and display an image forming status and the number of copies printed. Furthermore, through the operation portion 80, it is designated whether the sheet S is to be fed from the sheet cassette 16 or a manual paper feed tray (not shown), and thus a type or a size of the sheet S can be inputted. Various settings on the image forming apparatus 100 are made through a printer driver of a personal computer.

The control portion 90 includes at least a CPU central processing unit) 91 as a central computation device, a ROM (read-only memory) 92 that is a read-only storage portion, a RAM (random-access memory) 93 that is a readable and rewritable storage portion, the temporary storage portion 94 that temporarily stores image data or the like, a timer 95, and a plurality of (herein, two) I/Fs (interfaces) 96 that transmits a control signal to various devices in the image forming apparatus 100 or receives an input signal from the operation portion 80.

The ROM 92 contains a control program for the image forming apparatus 100 and data or the like not to be changed during use of the image forming apparatus 100, such as numerical values necessary for control. The RAM 93 stores necessary data generated in the course of controlling the image forming apparatus 100 and data or the like temporarily required for controlling the image forming apparatus 100.

The temporary storage portion 94 temporarily stores an image signal inputted through the image input portion 70 and converted into a digital signal. The timer 95 measures a drive time of the pressure-applying drive motor 47 from on or off timing of the reference position detection sensor 41 of the reference position detection mechanism 40.

Next, a description is given of control for adjusting a fixing nip pressure of the fixing device 13 in the image forming apparatus 100 of this embodiment. In this embodiment, the pressure-applying position of the pressure-applying roller 22 can be set in two tiers composed of a first pressure-applying position and a second pressure-applying position. Further, the pressure-applying position of the pressure-applying roller 22 is shifted depending on whether the sheet S passing through the fixing nip N is a normal sheet or a special sheet or depending on a basis weight (a weight per unit area) or the like of the sheet S in a case where the sheet S is a normal sheet, and thus it is possible to achieve both of conveyance capability and fixability of the sheet S.

In this specification, the term "normal sheet" refers to a sheet (a thin sheet, a plain sheet, a thick sheet, or the like) formed of a single layer of plant fiber. The term "special sheet" refers to a sheet (an envelope, a label sheet, an OHP sheet, or the like) formed of a single layer of a material other than plant fiber or a plurality of layers of plant fiber.

Table 1 shows an example of setting the pressure-applying position of the pressure-applying roller 22 in this embodiment. As shown in Table 1, in this embodiment, the pressure-applying position of the pressure-applying roller 22 can be set to either of the first pressure-applying position for applying a fixing nip pressure used as a reference pressure and the second pressure-applying position for applying a smaller nip pressure than at the first pressure-applying position. Furthermore, the pressure-applying position of the pressure-applying roller 22 can be set also to, in addition to these pressure-applying positions, the pressure reduction position and a jam treatment position.

TABLE 1

| Pressure-Applying Position | Pressure-Applying Position Detection Sensor | Timer |
|---|---|---|
| Jam Treatment Position | OFF | 3000 ms (Elapsed Time from Switching-off of Sensor) |
| Pressure Reduction Position | OFF | 1500 ms (Elapsed Time from Switching-off of Sensor) |
| Second Pressure-Applying Position | ON | 100 ms (Elapsed Time from Switching-on of Sensor) |
| First Pressure-Applying Position | ON | 400 ms (Elapsed Time from Switching-on of Sensor) |

The jam treatment position is defined to be a position where, upon reverse rotation of the shaft 35 (rotation thereof in the clockwise direction in FIG. 3), the pressure-applying drive motor 47 has been driven for 3000 ms from timing at which the reference position detection sensor 41 is brought to the off-state. The jam treatment position is set for removing the sheet S jammed (subjected to a paper jam in the fixing nip N.

The pressure reduction position is defined to be a position where, upon reverse rotation of the shaft 35 (rotation thereof in the clockwise direction in FIG. 3), the pressure-applying drive motor 47 has been driven for 1500 ms from timing at Which the reference position detection sensor 41 is brought to the off-state. The pressure reduction position is set in warming-up, the standby mode, or printing on a special sheet such as an envelope.

The first pressure-applying position is defined to be a position where, upon forward rotation of the shaft 35 (rotation thereof in the counterclockwise direction in FIG. 3), the pressure-applying drive motor 47 has been driven for 400 ms from timing at which the reference position detection sensor 41 is brought to the on-state. The first pressure-applying position is set in printing on a plain sheet (with a basis weight of 76 to 105 g/m$^2$) having an increased thickness, a thick sheet (with a basis weight of 106 to 300 g/m$^2$), or the like among different types of normal sheets.

The second pressure-applying position is defined to be a position where the pressure-applying drive motor 47 has been driven for 100 ins from timing at which the reference position detection sensor 41 is brought to the on-state. That is, the first pressure-applying position is a position where the pressure-applying drive motor 47 has been driven further for 300 ms beyond the second pressure-applying position. The second pressure-applying position is set in printing on a thin sheet (with a basis weight of 52 to 59 g/m$^2$), a plain sheet (with a basis weight of 60 to 75 g/m$^2$) having a reduced thickness, or the like among the different types of normal sheets.

Preferably, a fixing nip pressure at each of the first pressure-applying position and the second pressure-applying position is in such a range that when a fixing nip pressure P2 at the second pressure-applying position for applying a reduced fixing nip pressure is used as a reference (=1), a fixing nip pressure P1 at the first pressure-applying position is in a range of $1<P1<1.2$.

Figure 6:
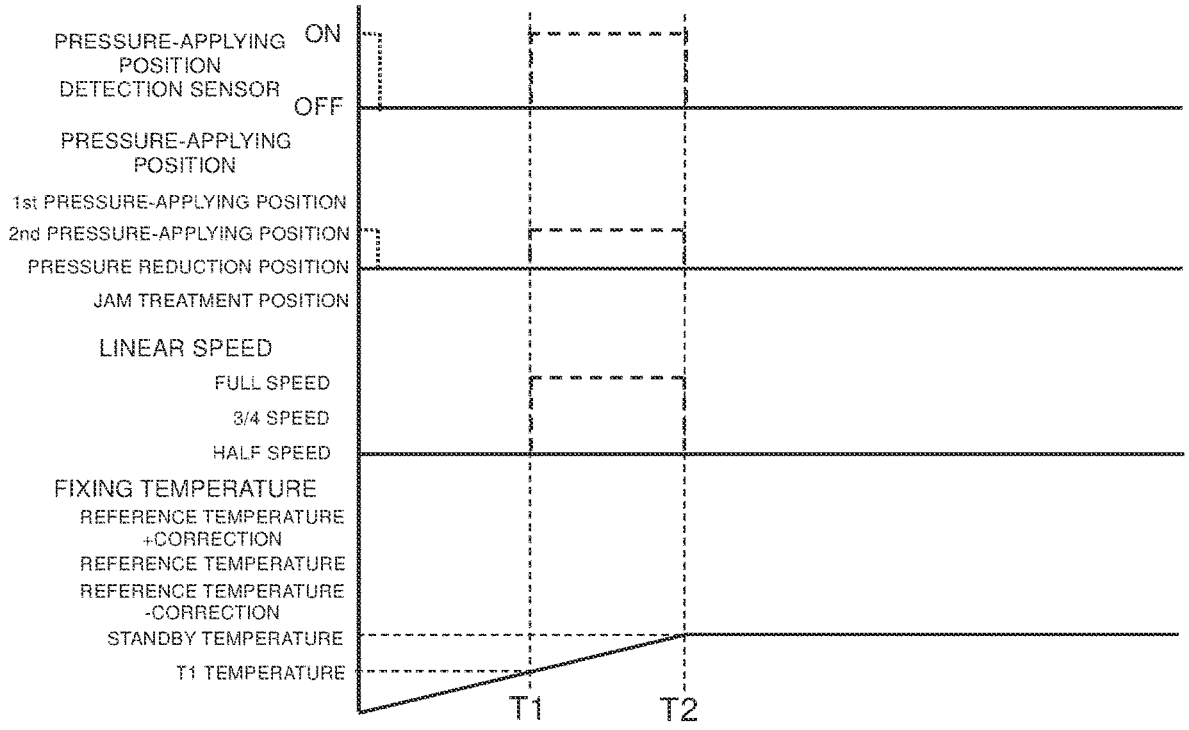
FIG. 6 is a timing chart showing an example of controlling the fixing device during warming-up and during a standby mode in the image forming apparatus of this embodiment.

FIG. 6 is a timing chart showing an example of controlling the fixing device 13 during warming-up and during the standby mode in the image forming apparatus 100 of this embodiment. As shown in FIG. 6, during warming-up, the pressure-applying roller 22 is disposed at the pressure reduction position, and the reference position detection sensor 41 is in the off-state. In this state, while the fixing drive motor 45 drives the pressure-applying roller 22 to rotate at a linear speed reduced to half (½ of its full speed), a voltage is applied from the fixing voltage power supply 55 to the heat-applying portion 23 so as to raise a fixing temperature to a standby temperature (warming-up).

After that, when the fixing temperature reaches the standby temperature at a lapse of a time T2 from a start of raising the temperature, while the voltage to be applied to the heat-applying portion 23 is controlled so as to maintain the fixing temperature at the standby temperature, the pressure-applying roller 22 is continued to rotate at the half speed in the state of being disposed at the pressure reduction position (the standby mode).

During a warming-up operation, when the fixing temperature reaches a T1 temperature (< the standby temperature) at a lapse of a time T1 (<T2), as shown by a broken line in FIG. 6, there may be performed control to increase the linear speed of the pressure-applying roller 22 (herein, to increase it from the half speed to the full speed) and to increase a magnitude of the fixing nip pressure (herein, to cause a positional shift from the pressure reduction position to the second pressure-applying position).

This control is intended so that, in a configuration in which the pressure-applying roller 22 has no heat source as in this embodiment, an amount of heat supplied from the fixing belt 21 to the pressure-applying roller 22 is increased so as to maintain a temperature of the pressure-applying roller 22 at a time of completion of warming-up. Whether to execute this control depends on specifications of the fixing device 13 or capabilities required thereof. For example, a temperature rising speed of the fixing belt 21 is higher under a condition of a reduced pressure and a low speed under which the amount of heat supplied to the pressure-applying roller 22 is small. For this reason, for example, in a case where the pressure-applying roller 22 has a heat source and a priority is given to raising a temperature of the fixing belt 21, preferably, this control is not executed.

Furthermore, in a case where, during warming-up, a printing instruction is inputted in a state where the pressure-applying roller 22 is disposed at the second pressure-applying position, preferably, printing is continuously performed, with the pressure-applying roller 22 kept disposed at the second pressure-applying position without being returned once to the pressure reduction position or with the pressure-applying roller 22 positionally shifted to the first pressure-applying position. This can reduce a wait time incurred due to movement of the pressure-applying roller 22.

Moreover, depending on a configuration of the pressure-applying mechanism 30 or the reference position detection mechanism 40, at a start of warming-up, a position of the pressure-applying roller 22 may become uncertain, that is, it may be indeterminable at which position the pressure-applying roller 22 is disposed. In such a case, as shown by a dotted line in FIG. 6, there is performed a pressure-applying operation in which the pressure-applying drive motor 47 is forwardly rotated at the start of warming-up, and once the reference position detection sensor 41 is brought to the on-state, the pressure-applying drive motor 47 is driven for 100 ins to move the pressure-applying roller 22 to the second pressure-applying position. Further, after the on-state of the reference position detection sensor 41 is detected, the pressure-applying roller 22 is moved to the pressure reduction position, and thus the position of the pressure-applying roller 2 can be determined.

Figure 7:
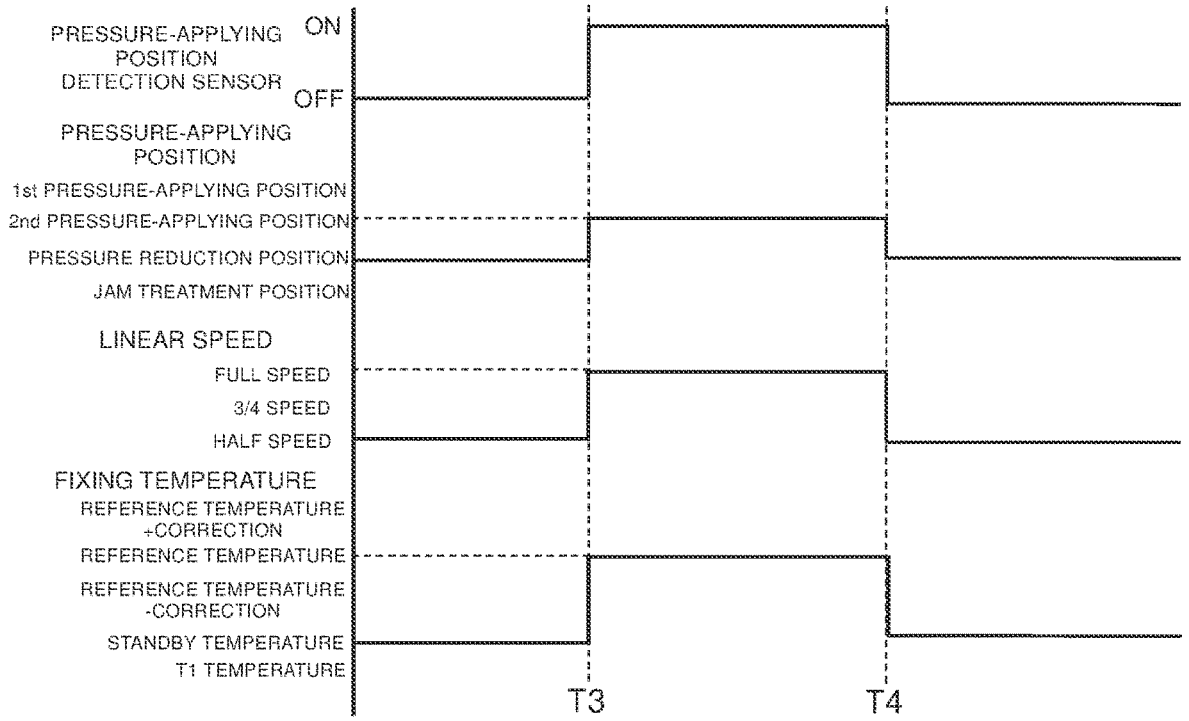
FIG. 7 is a timing chart showing an example of controlling the fixing device during image formation in the image forming apparatus of this embodiment in a case where a sheet used is a plain sheet having a reduced thickness.

FIG. 7 is a timing chart showing an example of controlling the fixing device 13 during image formation in the image forming apparatus 100 of this embodiment in a case where the sheet S is a plain sheet (with a basis weight of 60 to 75 g/m$^2$) having a reduced thickness. As shown in FIG. 7, when a printing instruction is inputted at a time T3, the pressure-applying drive motor 47 is forwardly rotated. Further, once the reference position detection sensor 41 is brought to the on-state, the pressure-applying drive motor 47 is driven for 100 ins to move the pressure-applying roller 22 to the second pressure-applying position. At the same time, the linear speed of the pressure-applying roller 22 is increased from the half speed to the full speed, and the fixing temperature is raised from the standby temperature to a reference temperature.

Then, upon an end of an image forming operation at a time 14, the pressure-applying drive motor 47 is reversely rotated. Further, once the reference position detection sensor 41 is brought to the off-state, the pressure-applying drive motor 47 is driven for 1500 ms to move the pressure-applying roller 22 to the pressure reduction position. At the same time, the linear speed of the pressure-applying roller 22 is decreased from the full speed to the half speed, and the fixing temperature is lowered from the reference temperature to the standby temperature, so that the image forming apparatus 100 is brought back to the standby mode.

Figure 8:
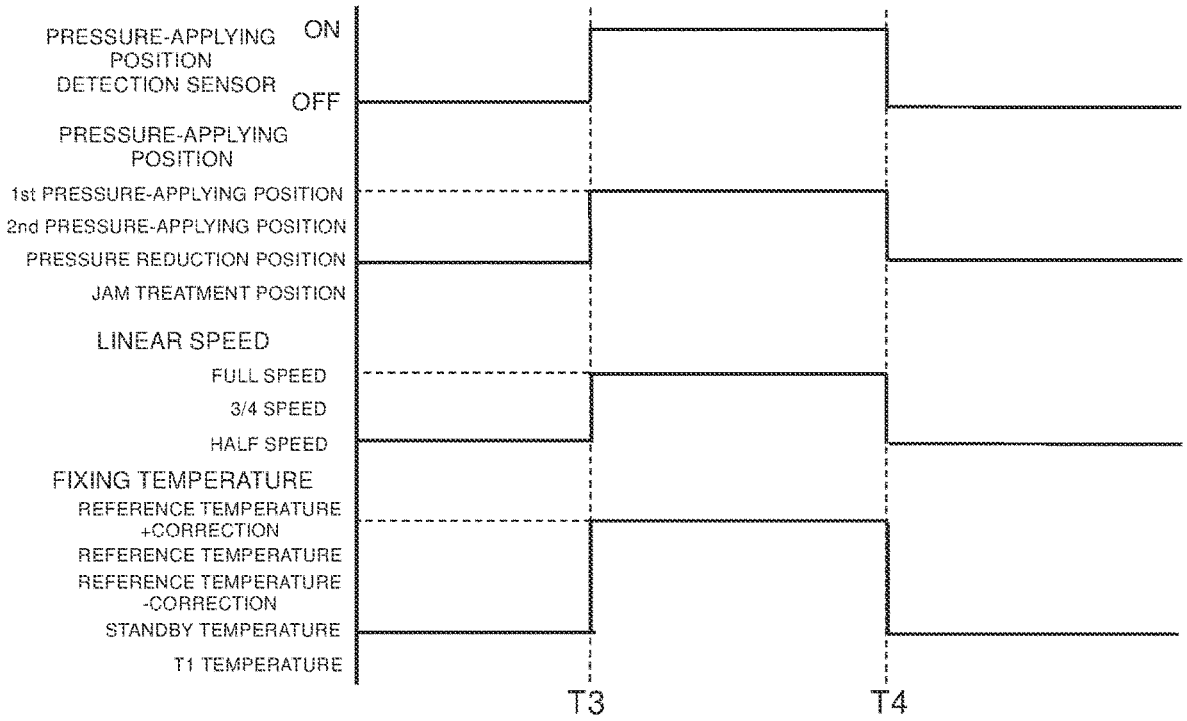
FIG. 8 is a timing chart showing an example of controlling the fixing device during image formation in the image forming apparatus of this embodiment in a case where a sheet used is a plain sheet having an increased thickness.

FIG. 8 is a timing chart showing an example of controlling the fixing device 13 during image formation in the image forming apparatus 100 of this embodiment in a case Where the sheet S is a plain sheet (with a basis weight of 76 to 105 g/m$^2$) having an increased thickness. In the case where the sheet S is a plain sheet having an increased thickness, when a printing instruction is inputted at the time 13, the pressure-applying drive motor 47 is forwardly rotated. Further, once the reference position detection sensor 41 is brought to the on-state, the pressure-applying drive motor 47 is driven for 400 ms to move the pressure-applying roller 22 to the first pressure-applying position. Furthermore, the fixing temperature is raised to a higher temperature (reference temperature+correction temperature) than the reference temperature, Other operations are similar to those shown in FIG. 7.

Figure 9:
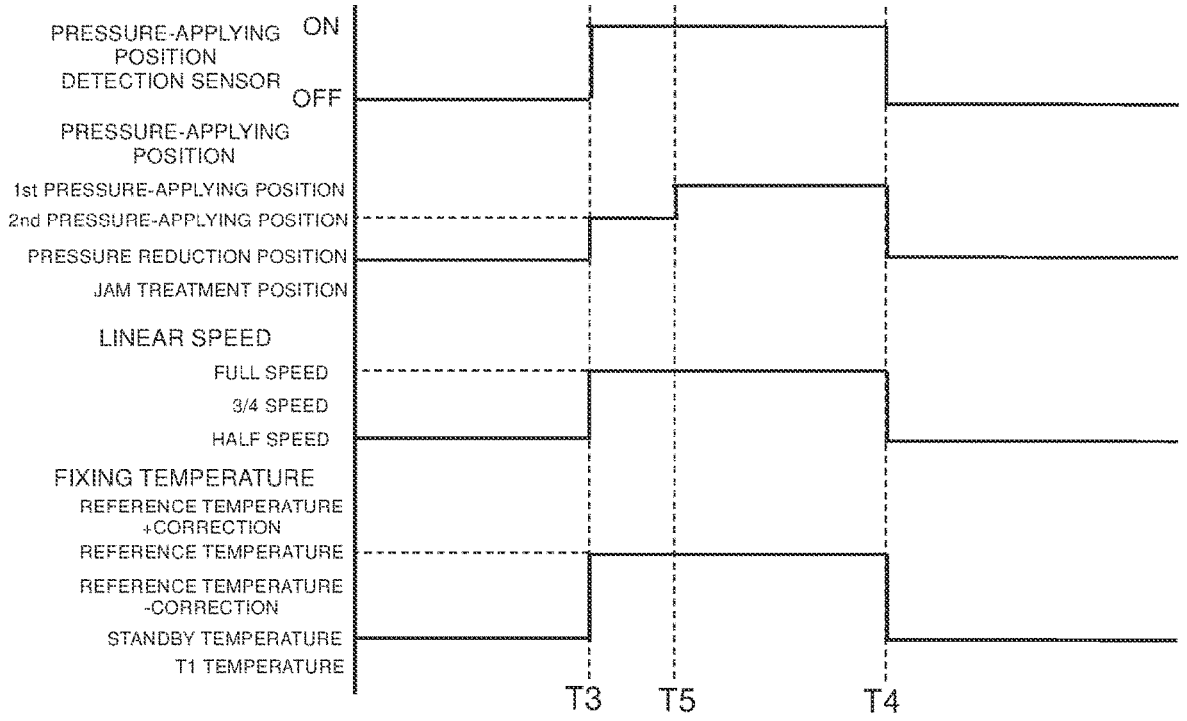
FIG. 9 is a timing chart showing another example of controlling the fixing device during image formation in the image forming apparatus of this embodiment in a case where a sheet used is a plain sheet having an increased thickness.

FIG. 9 is a timing chart showing another example of controlling the fixing device 13 during image formation in the image forming apparatus 100 of this embodiment in a case where the sheet S is a plain sheet having an increased thickness. FIG. 9 illustrates divided control in which in a case where information on a sheet type inputted through the operation portion 80 has not yet been determined when a printing instruction is inputted, the pressure-applying roller 22 is moved from the pressure reduction position to a pressure-applying position (herein, the first pressure-applying position) corresponding to the sheet type not in one step but in such a manner as to be moved once to the second pressure-applying position and then, at a point in time (a time T5) when a type of the sheet S is determined, moved to the first pressure-applying position.

As described above, the pressure-applying roller 22 is moved in a stepwise manner from the pressure reduction position to the second pressure-applying position and then to the first pressure-applying position, and thus in various situations including a case where information on the sheet S has not yet been grasped, such as a case where a sheet type inputted through the operation portion 80 when a printing instruction is inputted has not yet been determined, common control can be used to set a fixing condition. Accordingly, it is possible to simplify control of the image forming apparatus 100. The pressure-applying roller 22 is started to move to the second pressure-applying position at a point in time when a printing instruction is inputted so that movement of the pressure-applying roller 22 to a pressure-applying position corresponding to a type of the sheet S is completed in advance before the sheet S reaches the fixing device 13.

As a method for moving the pressure-applying roller 22 from the second pressure-applying position to the first pressure-applying position, there are two possible methods described below. In one (a first method) of the possible methods, the second pressure-applying position is a position where 100 ms have elapsed from timing at which the reference position detection sensor 41 is brought to the on-state, and the pressure-applying roller 22, which has been stopped at the second pressure-applying position, is driven further for 300 ms in a pressure-applying direction to move to the first pressure-applying position. In the other (a second method) of the possible methods, the pressure-applying roller 22 is moved once in a pressure reduction direction from the second pressure-applying position until the reference position detection sensor 41 is brought to the off-state and then driven in an inverted direction, namely, the pressure-applying direction, for 400 ms from timing at which the reference position detection sensor 41 is brought to the on-state to move to the first pressure-applying position.

The first method is advantageous in that a movement time is reduced, while the second method is advantageous in that the first pressure-applying position is always defined by an elapsed time from the on-state of the reference position detection sensor 41, and thus positional accuracy of the pressure-applying roller 22 is further enhanced. A choice could be made between these methods in consideration of a relationship between a required level of positional accuracy and the movement time.

Figure 10:
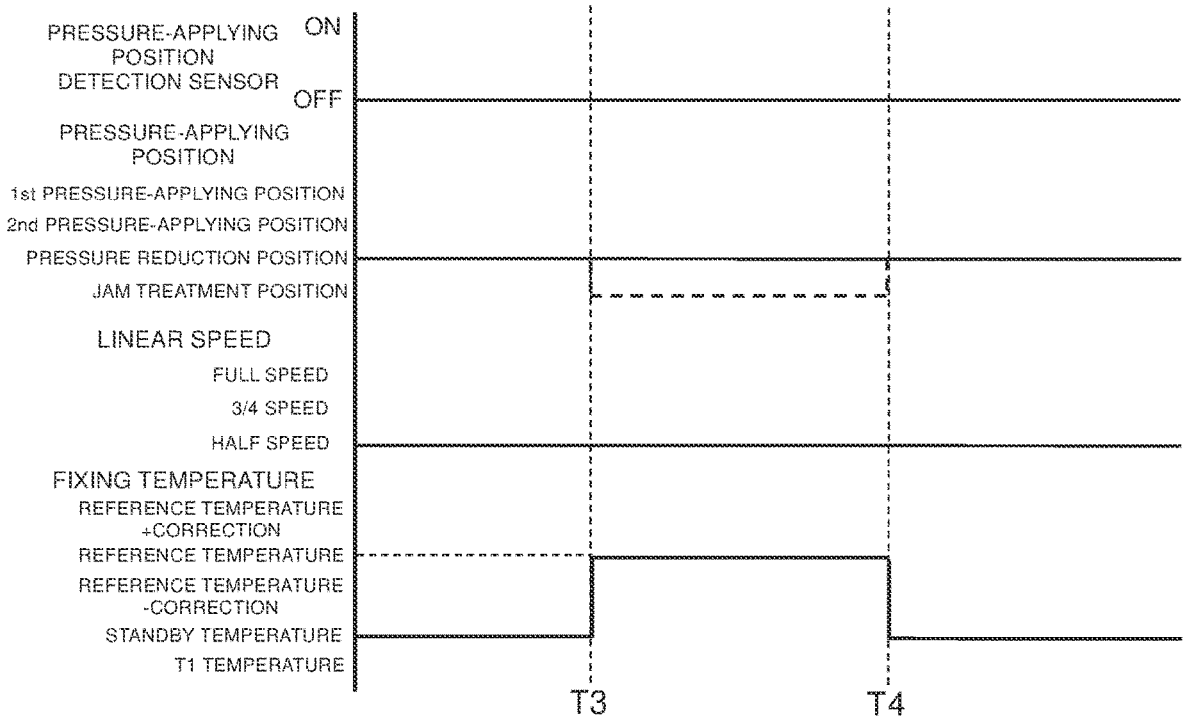
FIG. 10 is a timing chart showing an example of controlling the fixing device during image formation in the image forming apparatus of this embodiment in a case where a sheet used is an envelope.

FIG. 10 is a timing chart showing an example of controlling the fixing device 13 during image formation in the image forming apparatus 100 of this embodiment in a case where the sheet S is a special sheet (an envelope). In the case where the sheet S is an envelope, when a printing instruction is inputted at the time T3, for prevention of wrinkle formation, the pressure-applying roller 22 is kept disposed at the pressure reduction position and the linear speed thereof is maintained at the half speed. Further, the fixing temperature is raised from the standby temperature to the reference temperature, and printing is executed in that state.

In a case where a fixing nip pressure obtained is still high even at the pressure reduction position, as shown by a broken line in FIG. 10, printing could be executed, with the pressure-applying roller 22 disposed at the jam treatment position for applying an even lower fixing nip pressure, Table 2 provides a summary of examples of setting a type of the sheet S, the pressure-applying position of the pressure-applying roller 22, the linear speed thereof, and the fixing temperature.

TABLE 2

| Sheet Type | | Pressure-Applying Position | Linear Speed | Fixing Temperature |
|---|---|---|---|---|
| Normal Sheet | Thin Sheet | Second Pressure-Applying Position | Full Speed | Reference Temperature − Correction |
| | Plain Sheet (Having Reduced Thickness) | Second Pressure-Applying Position | Full Speed | Reference Temperature |
| | Plain Sheet (Having Increased Thickness) | First Pressure-Applying Position | Full Speed | Reference Temperature + Correction |
| | Thick Sheet | First Pressure-Applying Position | Half Speed | Reference Temperature + Correction |
| Special Sheet | Envelope | Pressure Reduction Position | Half Speed | Reference Temperature |
| | Postcard | First Pressure-Applying Position | Half Speed | Reference Temperature |
| | OHP Sheet | First Pressure-Applying Position | Half Speed | Reference Temperature + Correction |
| | Label Sheet | Pressure Reduction Position | Half Speed | Reference Temperature |
| | Coated Sheet | First Pressure-Applying Position | Half Speed | Reference Temperature + Correction |

The setting examples shown in Table 2 indicate schematic setting tendencies and may vary depending on a configuration of the fixing device 13, a magnitude of the fixing nip pressure applied by the pressure-applying mechanism 30, a linear speed region, or the like. Furthermore, a significant variation in fixing temperature might result in incurring a wait time when a sheet type is changed, and thus it is desirable to perform control not to cause such a significant variation in fixing temperature.

As discussed thus far, according to the configuration of this embodiment, as the pressure-applying position with respect to a normal sheet such as a thin sheet, a plain sheet, or a thick sheet, two pressure-applying positions that are the first pressure-applying position and the second pressure-applying position are provided and used appropriately in different ways. Thus, in a case where the fixing nip pressure is changed depending on a basis weight or a thickness of a sheet including not only a special sheet such as an envelope but also a normal sheet, there can be provided an image forming apparatus capable of achieving both of conveyance capability and fixability by using a simple mechanism and simple control.

Furthermore, this embodiment uses the reference position detection mechanism 40 in which when a prescribed amount of time has elapsed (when a rotation amount of the pressing cam 33 has reached a prescribed amount) from a time when the reference position detection sensor 41 is brought to the on-state, a desired pressure-applying position is achieved, and when a prescribed amount of time has elapsed (when the rotation amount of the pressing cam 33 has reached a prescribed amount) from a time when the reference position detection sensor 41 is brought to the off-state, a desired pressure reduction position is achieved. Thus, it is possible to accurately perform positioning of the pressure-applying roller 22 at a prescribed pressure-applying position or pressure reduction position).

Other than the above, the present disclosure is not limited to the foregoing embodiment and can be variously modified without departing from the spirit of the present disclosure. For example, while in the foregoing embodiment, as the pressure-applying position of the pressure-applying roller 22, two pressure-applying positions that are the first pressure-applying position and the second pressure-applying position are set, three or more pressure-applying positions may be set. In this case, the fixing nip pressure can be more finely set correspondingly to a type of the sheet S. Preferably, a fixing nip pressure at each of the three or more pressure-applying positions falls within a range of 1 to 1.2 where a fixing nip pressure at a pressure-applying position for applying a lowest fixing nip pressure is defined to be 1. Table 3 shows setting examples in a case where the pressure-applying position is set in three tiers. In the examples shown in Table 3, in addition to the first pressure-applying position and the second pressure-applying position, a third pressure-applying position for applying a lower fixing nip pressure than at the second pressure-applying position is provided.

TABLE 3

| Sheet Type | | Basis Weight (g/m) | Pressure-Applying Position | Linear Speed | Fixing Temperature |
|---|---|---|---|---|---|
| Normal Sheet | Thin Sheet | 52 to 59 | Third Pressure-Applying Position | ¾ Speed | Reference Temperature − Correction |
| | Plain Sheet 1 | 60 to 75 | Second Pressure-Applying Position | Full Speed | Reference Temperature |
| | Plain Sheet 2 | 76 to 90 | First Pressure-Applying Position | Full Speed | Reference Temperature + Correction |
| | Plain Sheet 3 | 91 to 105 | First Pressure-Applying Position | Full Speed | Reference Temperature + Correction |
| | Thick sheet 1 | 106 to 135 | First Pressure-Applying Position | ¾ Speed | Reference Temperature + Correction |
| | Thick sheet 2 | 136 to 163 | Second Pressure-Applying Position | Half Speed | Reference Temperature + Correction |
| | Thick sheet 3 | 164 to 220 | Second Pressure-Applying Position | Half Speed | Reference Temperature + Correction |
| | Thick sheet 4 | 221 to 256 | Third Pressure-Applying Position | Half Speed | Reference Temperature + Correction |
| | Thick sheet 5 | 257 to 300 | Third Pressure-Applying Position | Half Speed | Reference Temperature + Correction |

Furthermore, while the foregoing embodiment illustratively describes the fixing device 13 of a sliding belt type in which the endless fixing belt 21 as a rotary member to be heated slides against the nip forming member 24, needless to say, the present disclosure is applicable in an exactly similar manner to, for example, a one-shaft belt type fixing device in which the fixing belt 21 is wound on a fixing roller, a two-shaft belt type fixing device in which the fixing belt 21 is stretched over a fixing roller and a heat-applying roller, or a fixing device including a rotary member to be healed other than the fixing belt 21. Furthermore, the heat-applying portion 23 is also not limited to an induction heating type including an excitation coil and a core and can also be formed of, for example, a halogen heater.

Furthermore, the present disclosure is not limited to the fixing device 13 of a vertical conveyance type in which the sheet S passes through the fixing nip N from below toward above as described in the foregoing embodiment and is also applicable to a fixing device of a horizontal conveyance type in which the sheet S passes through the fixing nip N horizontally.

Furthermore, the image forming apparatus 100 is not limited to a tandem color printer as shown in FIG. 1, and the present disclosure is applicable to various types of image forming apparatuses including a fixing device, such as a monochrome copy machine, a digital multi-functional peripheral, a facsimile, and a laser printer.

The present disclosure is usable for an image forming apparatus including a fixing device in which a recording medium is inserted through a fixing nip formed by a rotary member to be healed and a pressure-applying member so that heat and pressure are applied to a toner image to fuse and fix the toner image onto the recording medium. Through the use of the present disclosure, it is possible to provide a fixing device capable of accurately adjusting a fixing nip pressure to a plurality of pressure-applying settings correspondingly to a type of a normal sheet, and an image forming apparatus including the same,

What is claimed is:

1. The image forming apparatus according to claim, wherein the pressure-applying mechanism selectively disposes the pressure-applying rotary member at a plurality of pressure reduction positions for applying the fixing nip pressure having different values from each other, each of the plurality of pressure reduction positions being identical to the pressure reduction position, and when, after reverse rotation of the pressure-applying drive motor, a prescribed amount of time has elapsed or when the rotation amount of the shaft has reached a prescribed amount from timing at which the reference position detection sensor is brought to the off-state, the pressure-applying drive motor is stopped so as to dispose the pressure-applying rotary member at any of the plurality of pressure reduction positions.

2. The image forming apparatus according to claim 1, wherein the plurality of pressure reduction positions includes a jam treatment position that is set for removing the recording medium jammed in the fixing nip.

3. An image forming apparatus, comprising:

an image forming portion that forms a toner image on a recording medium;

a fixing device including:

a rotary member to be heated;

a pressure-applying rotary member that is brought into pressure contact at a prescribed fixing nip pressure with the rotary member to be heated so as to form a fixing nip;

a heat-applying portion that heats the rotary member to be heated;

a pressure-applying mechanism including:

a pressure-applying lever that is used to move the pressure-applying rotary member in a direction toward or away from the rotary member to be heated;

a pressing cam that causes a pressing force applied by the pressure-applying lever to vary; and a pressure-applying drive motor that rotates a shaft to which the pressing cam is secured; and a reference position detection mechanism including;

a light blocking plate that is secured to the shaft; and a reference position detection sensor that is brought to an on-state or an off-state by the light blocking plate, the reference position detection mechanism detecting that the pressure-applying rotary member is at a reference position, the fixing device performing fixing processing in which the recording medium passing through the fixing nip is subjected to heating and pressing so that the toner image is fixed to the recording medium;

an input portion that s capable of receiving an input of information on a type of the recording medium; and a control portion that controls the pressure-applying mechanism based on the information on a type of the recording medium inputted through the input portion so as to adjust a position where the pressing is performed, wherein the pressure-applying mechanism selectively disposes the pressure-applying rotary member at a plurality of pressure-applying positions for applying the fixing nip pressure having different values from each other, which includes a first pressure-applying position and a second pressure-applying position for applying the fixing nip pressure having a value smaller than at the first pressure-applying position, and a pressure reduction position for applying the fixing nip pressure having a value smaller than at the pressure-applying positions, the control portion performs control so that, in a case where the recording medium is a normal sheet, the fixing processing is performed, with the pressure-applying rotary member disposed at any of the plurality of pressure-applying positions, and in a case where the recording medium is a special sheet, the fixing processing is performed, with the pressure-applying rotary member disposed at any of the plurality of pressure-applying positions and the pressure reduction position, the light blocking plate is so disposed that the reference position detection sensor is brought to the on-state at timing at which a rotation position of the pressing cam reaches a vicinity of any of the pressure-applying positions, when, after forward rotation of the pressure-applying drive motor, a prescribed amount of time has elapsed or when a rotation amount of the shaft has reached a prescribed amount from timing at which the reference position detection sensor is brought to the on-state, the pressure-applying drive motor is stopped so as to dispose the pressure-applying rotary member at any of the plurality of pressure-applying positions, and the fixing nip pressure at each of the plurality of pressure-applying positions falls within a range of 1 to 1.2 where the fixing nip pressure at one of the pressure-applying positions for applying a lowest fixing nip pressure is defined to be 1.

4. An image forming apparatus, comprising:

an image forming portion that forms a toner image on a recording medium;

a fixing device including:

a rotary member to be heated;

a pressure-applying rotary member that is brought into pressure contact at a prescribed fixing nip pressure with the rotary member to be heated so as to form a fixing nip;

a heat-applying portion that heats the rotary member to be heated;

a pressure-applying mechanism including:

a pressure-applying lever that is used to move the pressure-applying rotary member in a direction toward or away from the rotary member to be heated;

a pressing cam that causes a pressing force applied by the pressure-applying lever to vary; and a pressure-applying drive motor that rotates a shaft to which the pressing cam is secured; and a reference position detection mechanism including;

a light blocking plate that is secured to the shaft; and a reference position detection sensor that is brought to an on-state or an off-state by the light blocking plate, the reference position detection mechanism detecting that the pressure-applying rotary ember is at a reference position, the fixing device performing fixing processing in which the recording medium passing through the fixing nip is subjected to heating and pressing so that the toner image is fixed to the recording medium;

an input portion that is capable of receiving an input of information on a type of the recording medium; and a control portion that controls the pressure-applying mechanism based on the information on a type of the recording medium inputted through the input portion so as to adjust a position where the pressing is performed, wherein the pressure-applying mechanism selectively disposes the pressure-applying rotary member at a plurality of pressure-applying positions for applying the fixing nip pressure having different values from each other, which includes a first pressure-applying position and a second pressure-applying position for applying the fixing nip pressure having a value smaller than at the first pressure-applying position, and a pressure reduction position for applying the fixing nip pressure having a value smaller than at the pressure-applying positions, the control portion performs control so that, in a case where the recording medium is a normal sheet, the fixing processing is performed, with the pressure-applying rotary member disposed at any of the plurality of pressure-applying positions, and in a case where the recording medium is a special sheet, the fixing processing is performed, with the pressure-applying rotary member disposed at any of the plurality of pressure-applying positions and the pressure reduction position, the light blocking plate is so disposed that the reference position detection sensor is brought to the on-state at timing at which a rotation position of the pressing cam reaches a vicinity of any of the pressure-applying positions, when, after forward rotation of the pressure-applying drive motor, a prescribed amount of time has elapsed or when a rotation amount of the shaft has reached a prescribed amount from timing at which the reference position detection sensor is brought to the on-state, the pressure-applying drive motor is stopped so as to dispose the pressure-applying rotary member at any of the plurality of pressure-applying positions, and the control portion performs control so that at a start of warming-up in which a fixing temperature that is a temperature of the rotary member to be heated is raised to a standby temperature, the pressure-applying rotary member is driven to rotate at a prescribed linear speed in a state of being disposed at the pressure reduction position, when the fixing temperature reaches a prescribed temperature lower than the standby temperature during the warming-up, the linear speed of the pressure-applying rotary member is increased, while the pressure-applying rotary member is moved from the pressure reduction position to the second pressure-applying position, and when the fixing temperature reaches the standby temperature, the linear speed of the pressure-applying rotary member is returned to an original speed, while the pressure-applying rotary member is moved from the second pressure-applying position to the pressure reduction position.

5. The image forming apparatus according to claim 4, wherein the control portion performs control so that, in a case where, during the warming-up, a printing instruction is inputted in a state where the pressure-applying rotary member is disposed at the second pressure-applying position, based on the type of the recording medium, the pressure-applying rotary member is held at the second pressure-applying position or disposed at either of one of the pressure-applying positions different from the second pressure-applying position and the pressure reduction position.

6. The image forming apparatus according to claim 5, wherein in a case of disposing the pressure-applying rotary member from the second pressure-applying position to either of the one of the pressure-applying positions different from the second pressure-applying position and the pressure reduction position, the control portion controls the pressure-applying drive motor to forwardly or reversely rotate for a prescribed amount of time from the second pressure-applying position.

7. The image forming apparatus according to claim 5, wherein in a case of disposing the pressure-applying rotary member from the second pressure-applying position to either of the one of the pressure-applying positions different from the second pressure-applying position and the pressure reduction position, the control portion performs control so that the pressure-applying drive motor is rotated to bring the reference position detection sensor to the on-state or the off-state, and after detection that the pressure-applying rotary member is at the reference position, the pressure-applying drive motor is forwardly or reversely rotated for a prescribed amount of time.

8. The image forming apparatus according to claim 4, wherein the pressure-applying mechanism selectively disposes the pressure-applying rotary member at a plurality of pressure reduction positions for applying the fixing nip pressure having different values from each other, each of the plurality of pressure reduction positions being identical to the pressure reduction position, and when, after reverse rotation of the pressure-applying drive motor, a prescribed amount of time has elapsed or when the rotation amount of the shaft has reached a prescribed amount from timing at which the reference position detection sensor is brought to the off-state, the pressure-applying drive motor is stopped so as to dispose the pressure-applying rotary member at any of the plurality of pressure reduction positions.

9. The image forming apparatus according to claim 8, wherein the plurality of pressure reduction positions includes a jam treatment position that is set for removing the recording medium jammed in the fixing nip.

10. An image forming apparatus, comprising:

an image forming portion that forms a toner image on a recording medium;

a fixing device including:

a rotary member to be heated;

a pressure-applying rotary member that is brought into pressure contact at a prescribed fixing nip pressure with the rotary member to be heated so as to form a fixing nip;

a heat-applying portion that heats the rotary member to be heated;

a pressure-applying mechanism including:

a pressure-applying lever that is used to move the pressure-applying rotary member in a direction toward or away from the rotary member to be heated;

a pressing cam that causes a pressing force applied by the pressure-applying lever to vary; and a pressure-applying drive motor that rotates a shaft to which the pressing cam is secured; and a reference position detection mechanism including;

a light blocking plate that is secured to the shaft; and a reference position detection sensor that is brought to an on-state or an off-state by the light blocking plate, the reference position detection mechanism detecting that the pressure-applying rotary member is at a reference position, the fixing device performing fixing processing in which the recording medium passing through the fixing nip is subjected to heating and pressing so that the toner image is fixed to the recording medium;

an input portion that s capable of receiving an input of information on a type of the recording medium; and a control portion that controls the pressure-applying mechanism based on the information on a type of the recording medium inputted through the input portion so as to adjust a position where the pressing is performed, wherein the pressure-applying mechanism selectively disposes the pressure-applying rotary member at a plurality of pressure-applying positions for applying the fixing nip pressure having different values from each other, which includes a first pressure-applying position and a second pressure-applying position for applying the fixing nip pressure having a value smaller than at the first pressure-applying position, and a pressure reduction position for applying the fixing nip pressure having a value smaller than at the pressure-applying positions, the control portion performs control so that, in a case where the recording medium is a normal sheet, the fixing processing is performed, with the pressure-applying rotary member disposed at any of the plurality of pressure-applying positions, and in a case where the recording medium is a special sheet, the fixing processing is performed, with the pressure-applying rotary member disposed at any of the plurality of pressure-applying positions and the pressure reduction position, the light blocking plate is so disposed that the reference position detection sensor is brought to the on-state at timing at which a rotation position of the pressing cam reaches a vicinity of any of the pressure-applying positions, when, after forward rotation of the pressure-applying drive motor, a prescribed amount of time has elapsed or when a rotation amount of the shaft has reached a prescribed amount from timing at which the reference position detection sensor is brought to the on-state, the pressure-applying drive motor is stopped so as to dispose the pressure-applying rotary member at any of the plurality of pressure-applying positions, and the control portion performs control so that, in a case where the information on a type of the recording medium has not yet been determined at a point in time when a printing instruction is inputted, the pressure-applying rotary member is disposed at the second pressure-applying position, and at a point in time when the type of the recording medium is determined, the pressure-applying rotary member is held at the second pressure-applying position or disposed at either of one of the pressure-applying positions different from the second pressure-applying position and the pressure reduction position.

11. The image forming apparatus according to claim 10, wherein the pressure-applying mechanism selectively disposes the pressure-applying rotary member at a plurality of pressure reduction positions for applying the fixing nip pressure having different values from each other, each of the plurality of pressure reduction positions being identical to the pressure reduction position, and when, after reverse rotation of the pressure-applying drive motor, a prescribed amount of time has elapsed or when the rotation amount of the shaft has reached a prescribed amount from timing at which the reference position detection sensor is brought to the off-state, the pressure-applying drive motor is stopped so as to dispose the pressure-applying rotary member at any of the plurality of pressure reduction positions.

12. The image forming apparatus according to claim 11, wherein the plurality of pressure reduction positions includes a jam treatment position that is set for removing the recording medium jammed in the fixing nip.

13. An image forming apparatus, comprising:

an image forming portion that forms a toner image on a recording medium;

a fixing device including:

a rotary member to be heated;

a pressure-applying rotary member that is brought into pressure contact at a prescribed fixing nip pressure with the rotary member to be heated so as to form a fixing nip;

a heat-applying portion that heats the rotary member to be heated;

a pressure-applying mechanism including:

a pressure-applying lever that is used to move the pressure-applying rotary member in a direction toward or away from the rotary member to be heated;

a pressing cam that causes a pressing force applied by the pressure-applying lever to vary; and a pressure-applying drive motor that rotates a shaft to which the pressing cam is secured; and a reference position detection mechanism including;

a light blocking plate that is secured to the shaft; and a reference position detection sensor that is brought to an on-state or an off-state by the light blocking plate, the reference position detection mechanism detecting that the pressure-applying member is at a reference position, the fixing device performing fixing processing in which the recording medium passing through the fixing nip is subjected to heating and pressing so that the toner image is fixed to the recording medium;

an input portion that s capable of receiving an input of information on a type of the recording medium; and a control portion that controls the pressure-applying mechanism based on the information on a type of the recording medium inputted through the input portion so as to adjust a position where the pressing is performed, wherein the pressure-applying mechanism selectively disposes the pressure-applying rotary member at a plurality of pressure-applying positions for applying the fixing nip pressure having different values from each other, which includes a first pressure-applying position and a second pressure-applying position for applying the fixing nip pressure having a value smaller than at the first pressure-applying position, and a pressure reduction position for applying the fixing nip pressure having a value smaller than at the pressure-applying positions, the control portion performs control so that, in a case where the recording medium is a normal sheet, the fixing processing is performed, with the pressure-applying rotary member disposed at any of the plurality of pressure-applying positions, and in a case where the recording medium is a special sheet, the fixing processing is performed, with the pressure-applying rotary member disposed at any of the plurality of pressure-applying positions and the pressure reduction position, the light blocking plate is so disposed that the reference position detection sensor is brought to the on-state at timing at which a rotation position of the pressing cam reaches a vicinity of any of the pressure-applying positions, when, after forward rotation of the pressure-applying drive motor, a prescribed amount of time has elapsed or when a rotation amount of the shaft has reached a prescribed amount from timing at which the reference position detection sensor is brought to the on-state, the pressure-applying drive motor is stopped so as to dispose the pressure-applying rotary member at any of the plurality of pressure-applying positions, and the control portion performs control so that at a point in time when a printing instruction is inputted, the pressure-applying rotary member is disposed at the second pressure-applying position, and based on the type of the recording medium inputted through the input portion, the pressure-applying rotary member is held at the second pressure-applying position or disposed at either of one of the pressure-applying positions different from the second pressure-applying position and the pressure reduction position.

14. The image forming apparatus according to claim 13, wherein the pressure-applying mechanism selectively disposes the pressure-applying rotary member at a plurality of pressure reduction positions for applying the fixing nip pressure having different values from each other, each of the plurality of pressure reduction positions being identical to the pressure reduction position, and when, after reverse rotation of the pressure-applying drive motor, a prescribed amount of time has elapsed or when the rotation amount of the shaft has reached a prescribed amount from timing at which the reference position detection sensor is brought to the off-state, the pressure-applying drive motor is stopped so as to dispose the pressure-applying rotary member at any of the plurality of pressure reduction positions.

15. The image forming apparatus according to claim 14, wherein the plurality of pressure reduction positions includes a jam treatment position that is set for removing the recording medium jammed in the fixing nip.

* * * * *